US005125190A

United States Patent [19]

Buser et al.

[11] Patent Number: 5,125,190

[45] Date of Patent: Jun. 30, 1992

[54] DUST COLLECTOR AND SHIELD FOR ROTARY GRINDER

[76] Inventors: John P. Buser, 837 Cornish Dr.; Michael Courson, P.O. Box 7383, both of San Diego, Calif. 92107

[21] Appl. No.: 524,130

[22] Filed: May 16, 1990

[51] Int. Cl.[5] ..... B24B 55/06

[52] U.S. Cl. ..... 51/273; 51/170 T

[58] Field of Search ..... 51/273, 170 T, 170 R, 51/268, 262 R

[56] References Cited

U.S. PATENT DOCUMENTS

| | | | |
|---|---|---|---|
| 2,478,074 | 8/1949 | Atkin | 51/273 |
| 3,862,521 | 1/1975 | Isaksson | 51/273 |
| 3,882,644 | 5/1975 | Cusumano | 51/170 |
| 4,135,334 | 1/1979 | Rudiger | 51/273 |
| 4,381,628 | 5/1983 | Dicke | 51/170 |
| 4,622,782 | 11/1986 | Roestenberg | 51/273 |
| 4,697,389 | 10/1987 | Romine | 51/180 |
| 4,782,632 | 11/1988 | Matechuk | 51/180 |

FOREIGN PATENT DOCUMENTS

| | | | |
|---|---|---|---|
| 2539762 | 3/1977 | Fed. Rep. of Germany | 51/273 |
| 211467 | 12/1982 | Japan | 51/273 |
| 715760 | 9/1954 | United Kingdom | 51/273 |

*Primary Examiner*—Roscoe V. Parker

*Attorney, Agent, or Firm*—Brown, Martin Haller & McClain

[57] ABSTRACT

A shield attachment for fitting on a rotating grinder that encloses and shields the rotating grinder disc or pad, and provides a tangential exhaust port for exhausting dust in moving air created by the rotating disc. The shield has an encircling skirt that rests on the work surface, making an enclosed air cavity around the rotating disc that shields against particles being radiated at high speeds and also contains the air with contaminating dust in its restricted passage to the exhaust. The shield has flexible means for allowing vertical movement of the skirt to assure an enclosed chamber, and has separate air holes for providing air flow to the chamber to replace the air passing through the exhaust port.

8 Claims, 2 Drawing Sheets

DUST COLLECTOR AND SHIELD FOR ROTARY GRINDER

BACKGROUND OF THE INVENTION

Rotary grinders are used extensively in industry. More specifically angle type grinders/sanders of the grinding disc or pad type, are used for grinding fiberglass, wood, steel, removing asbestos and body filler in automobile shops, and for making boats and similar products. In use this grinder creates large quantities of dust that are both a fire hazard and a health hazard. Wood dust, for example, can be very explosive over a wide range of concentrations and is a known fire hazard. Hot metal grindings are particularly dangerous as fire starters. Both wood dust and metal filings as well as asbestos particles, fiberglass and body filler particles create known health hazards to users of the grinders and to others in the immediate environment.

Further, grinder discs and pads often rotate in the order of 7,000 revolutions per minute (RPM). Grinding pads that use a sponge type backing material create a hazard where parts or particles from the backing material break off and are shot from the rotating disc tangently at a high rate of speed. In this regard, it is often necessary to use a rotary grinder to grind into corners or against surfaces that have side edges, that can cause particles of the foam backing material to break off from the high speed rotating disc and hit the operator or other persons or equipment in the immediate area.

While there are prior art shrouds that go over the rotating disc, they are generally characterized by providing an enclosure that has openings around the shroud that allows material and dust to be shot out from the rotating disc or pad; or that have end portions open through which the dust and particles can escape or be distributed from rotating discs at a high speed; or comprise complex mechanism that contemplate spinning the shroud with rotating disc; all of which cause problems in use.

So it is desirable to provide a simple hood attachment that completely encloses the rotating grinding disc or pad and protects the surrounding area from particles being shot out or rotatably distributed from the rotating grinding disc. It is further desirable to have a means of collecting the rotating particles and the contaminated air flow generated by the rotating disc or pad through a tangently oriented exhaust opening through the enclosing hood or shroud. It is further desirable to have a shroud or hood with an enclosing skirt that floats against and with the work surface, and which skirt is capable of flexible resilient vertical movement to follow the surface of the work being ground by the grinding disc. It is further desirable to have a means for providing air to the chamber enclosed by the hood, to resupply the air flow out the exhaust port.

SUMMARY OF THE INVENTION

This invention is based upon the realization by the inventors that many of the prior problems involved in protecting users of rotary grinders/sanders from dust and high speed moving particles generated or created by the grinders in use, and from the dust in a clouded environment, can be eliminated or substantially reduced. This is accomplished by completely shielding the rotating disc or pad in use, and removing the particles by an air flow through the hood to an exhaust port. The air in the air flow moves from the outside environment through upper openings in the hood to the volume adjacent the moving rotary disc and then out the exhaust port. This is accomplished while providing the hood with the capability of vertical resilient movement either as a unit, or on one side. The restricted volume adjacent the rotating disc increases the ability of the rotating disc to force or cause the dust and air flow to exit the exhaust port, while maintaining a guided contact with the work surface. The flexible portion on the hood further allows side movement of the hood relative to the grinder disc and the drive mechanism. This allows the grinder disc to be used on irregular work surfaces, or be moved into virtual contact with walls or corner surfaces, and still protect the high speed rotating grinding pads, through the intermediate rigid skirt, from destructive contact with the side walls at edges of the work surface.

The hood that accomplishes this comprises an upper surface and an outer enclosing circular skirt that fits around and encloses the rotating disc or pad. The center of the upper surface has a collar that attaches to the fixed end of a conventional grinder. The collar encircles an opening through which the grinder's rotating drive shaft is connected to the grinding disc or pad. The grinding disc grinds in a plane that is parallel with the upper surface of the hood or shroud. The upper hood surface has a concentric circular flexible portion that allows the skirt to ride on the work surface and to be raised or lowered with irregularities of the work surface, and yet maintain a contact with the work surface to protect against high speed particles leaving the rotating grinder, and further to maintain a closed hood, air volume that creates a contained air flow that cooperates with the rotating force of the grinder to drive particles and air through an opening in the skirt. This opening is to a tangently oriented exhaust port that either connects directly to a hose and exhaust bag, or to a motorized vacuum pump. The vacuum pump draws air through openings in the upper surface of the hood, thus pulling the air and dust and particles through the exhaust port into a collector bag. Also since the lower edge surface of the skirt is uniform, means are provided for cutting off a portion of the lower edge of the skirt to adjust the height of the skirt with the spacing of the grinding face of the disc or pad to the driving axle of the drive shaft of the grinding motor.

It is therefore an object of this invention to provide a new and improved dust collector and shield for rotary grinders.

Other objects and many attendant advantages of this invention will become more apparent upon a reading of the specification and an examination of the drawings, wherein like reference numerals designate like parts throughout and in which:

DETAILED DESCRIPTION OF THE PREFERRED EMBODIMENTS

Figure 1:
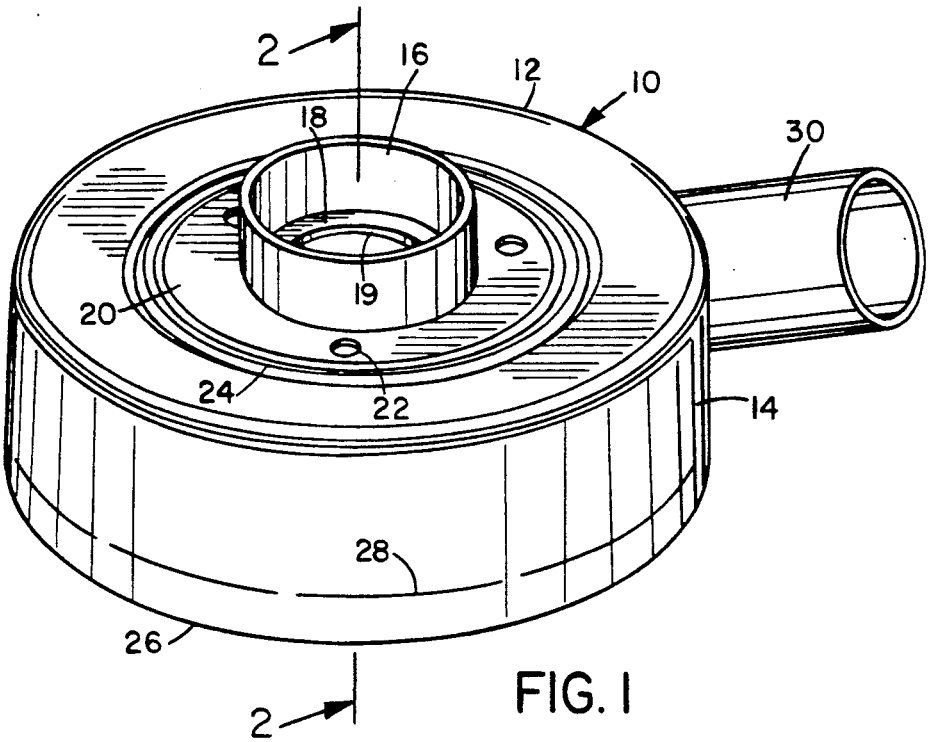
FIG. 1 is a perspective view of the shield.
Figure 2:
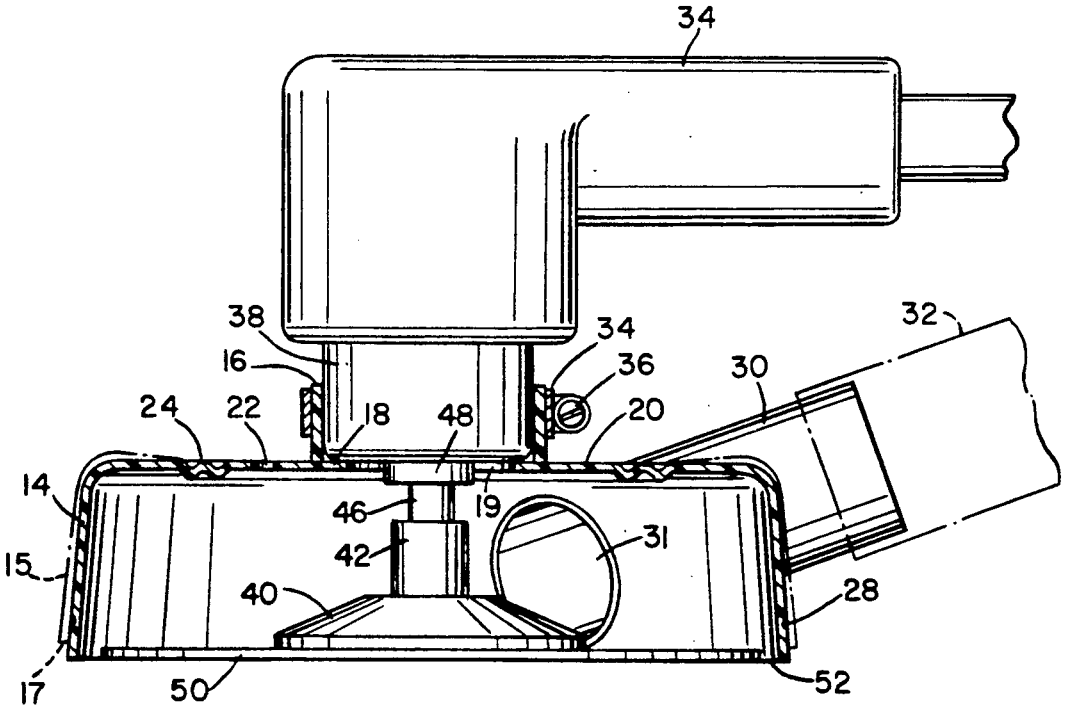
FIG. 2 is a sectional view taken along lines 2—2 of FIG. 1, with a typical grinder or sander tool installed.

Referring to FIGS. 1 and 2, the shield 10 comprises a hood that can be an integral structure made of a translucent or transparent molded plastic, or of fiberglass or metal, or of any other suitable material. The hood or shield has an upper surface 12 with an integral skirt 14 that flares slightly outwardly in the downward direction. The skirt has a lower, circular edge portion 26 that is in a single plane. The skirt also has an exhaust opening 31 connected to an exhaust port 30 that is aligned tangently with the skirt, and is angled upwardly at about a 0 to 15 degree angle.

The upper surface 12 has an attachment collar 16, see FIG. 2, that is dimensioned to fit onto the housing 38 of a conventional grinder 34. The collar encircles a hole or opening 19 having a rim 18. The drive shaft 46 of the grinder 34 projects through bearing 48 and through opening 19, with an end of housing 38 abutting against rim 18. In this position, a hose type clamp 34 and setting screw 36 tightens the collar 16 around housing 38 to hold the shield 10 in position. It may be understood that the attachment collar 16 may have any desired diameter or may be of a flexible material attached to the upper surface 20 of the shield 10, to accommodate the hose clamp securing the shield 10 onto housings 38 that may vary in diameter.

Figure 3:
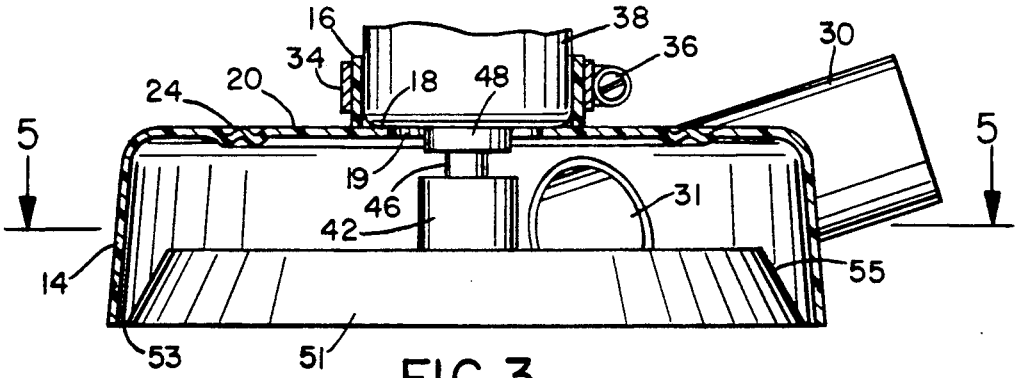
FIG. 3 is a similar sectional view with an alternative rigid grinder pad enclosed in the shield.

Referring to FIGS. 2 and 3, a rotatable sanding disc 50 is connected to a circular support 40 that has a collar 42 that connects with the drive shaft 46 of the grinder 34. The collar 42 may be secured to drive shaft 46 by set screw or other suitable means. The spacing of the disc 50 relative to the drive shaft 46 is adjusted so that the plane of the disc 50 corresponds to the end edge surface 26 of shield 12.

Referring to FIG. 3, a grinding pad 51 comprises a sponge material that may be of high density polyurethane foam. This pad is used in place of the grinding disc 50. Grinding pad 51 is generally characterized by having an inwardly angled conical type surface 55.

The upper surface 12 of the shield 10 has a corrugated, flexible portion 24 encircling the inner surface 20 that allows the skirt and the outer surface 12 to be resiliently biased to a given position. Accordingly, see FIG. 2, the skirt 14 may be flexibly moved vertically as illustrated by the skirt illustrated in dotted line in FIG. 2, with the edge surface 17 being moved vertically. This allows the edge surface 17 or edge surface 26 of the skirt to have flexible vertical movement that follows changes in the work surface being ground by the grinder disc 50 or the grinder pad 51. This flexible movement may be uniform for the entire lower edge surface of the skirt, or may only flex on one side, depending upon the undulations of the work surface. In any case, the skirt allows maximum contact of the lower edge surface 26 of the skirt 14 with the work surface, providing an enclosed chamber around the rotating disc. This chamber has air holes 22 that permit air to flow into the chamber and supply air to the air movement that is created by the rotating disc. This air movement and the particles generated by the disc in the chamber move through the exhaust opening 31 to exhaust port 30.

Figure 4:
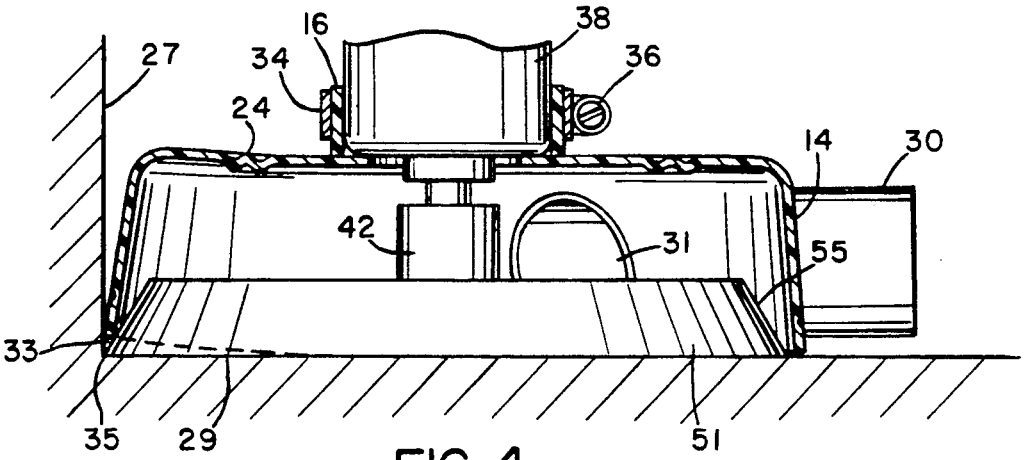
FIG. 4 is a similar sectional view illustrating deflection of the shield when grinding or sanding into a corner.
Figure 5:
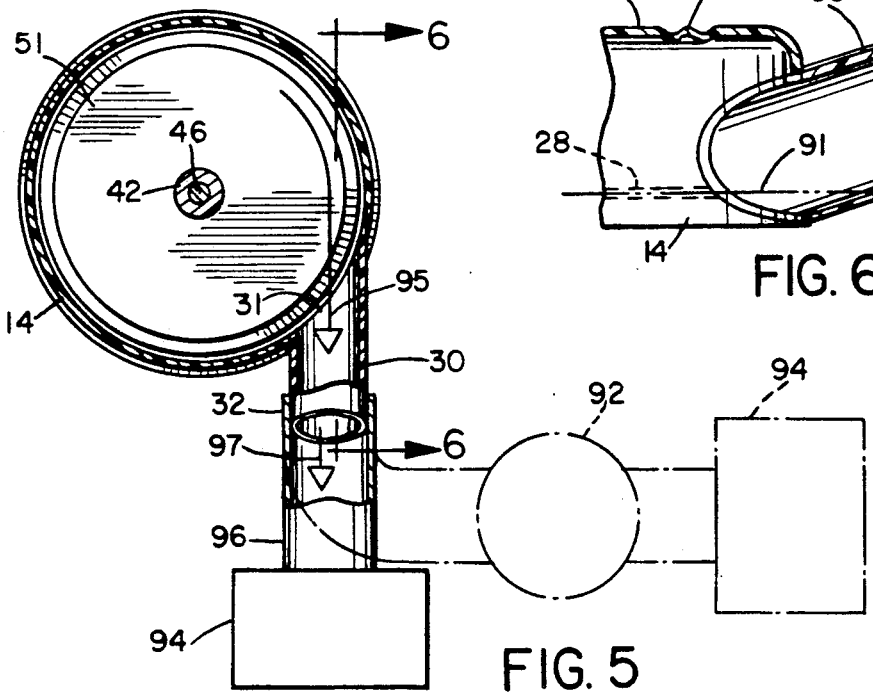
FIG. 5 is a top view of a section taken along lines 5—5 of FIG. 3 with the added exhaust port that is connected to a vacuum pump and collector bag, or alternatively to an output conduit to a collector bag.

In this regard, the exhaust port may be connected to an exhaust tube 32, see FIG. 5, that is connected to a vacuum pump 92 that pulls the air from the chamber in the shield through opening 31, port 30, in the direction of arrows 95 and 97 and through hose connector 32 to the vacuum pump 92. This deposits the air and particles into a collector bag 94, in the manner of a known carpet sweeper. Alternatively, the vacuum pump can in some operations be eliminated, with the air and particles being driven in the direction of arrow 95 and 97 through exhaust hose 96 directly into a bag 94. Also as illustrated in FIG. 4, the exhaust port can also be horizontal.

Figure 6:
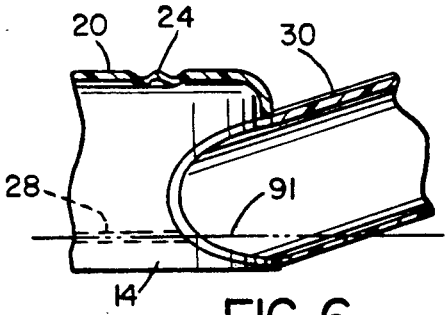
FIG. 6 is a sectional view with parts broken away that illustrate the removal of a section of the skirt in connection with the exhaust port.

In use of the shield 10 with different grinding discs and pads, it may be necessary to adjust the height of the skirt. So the shield skirt is scored by the indentation 28. This provides for easy removal of the lower portion of the skirt to correspond with a known different sized disc or pad to be enclosed by the shield 10. The exhaust port opening 31, see FIGS. 2 and 6, is positioned fairly close to the lower edge 26 of the skirt 14. This allows for direct movement of the particles in their most concentrated plane of movement, which is immediately adjacent the rotating disc 50. The removal of the lower portion of the skirt along the scored indentation 28 merely cuts off a portion of the opening 31, but still allows the enclosed contact of opening 31 and exhaust port 30 with the work surface.

IN OPERATION

In operation, the shield 10 is fitted against the housing 38 and the hose clamp 34 is tightened by the hose clamp screw 36 to a tight connection. A disc 50 or a grinding pad 51 is connected through collar 42 onto the drive shaft 46. The rotating plane of the grinding surface of the disc 50 or pad 51 is generally oriented to be in the plane of the lower edge surface 26 of the housing or shield 10. However, any misalignments are easily adjusted by the flexible movement vertically of skirt 14, which is permitted by the corrugated flexible portion 24.

In grinding or sanding, particularly with grinding pad 51, it is desirable that the operation be observed by the user. Accordingly the shield is preferably made of a transparent material so that the user can observe the position of the grinding pad or disc on the work surface. The operator of course wants to use the grinding surface to grind the entire work surface, including the outer edges and also against side walls 27, see FIG. 4, and in corners 35. Where the grinder doesn't have shield 10, this is usually dangerous with known shields or just not possible. However, in this invention, the pad 51 is merely pushed into the corner 35 with the skirt 14 rising up the conical surface 55 of the pad 51 and being flexed around the corrugated flexible portion 24. At all times during this operation, the integrity of the shield is maintained with the other side edge of the shield 14 still contacting the work surface as illustrated in FIG. 4. It may be recognized, that in this operation the high density polyurethane foam of pad 51 is most likely to experience some disintegration of its outer surface causing particles to leave the foam material at a high speed. The shield can prevent this, or at least prevent such particles from being radiated outside shield 10.

In collecting the particles, a vacuum pump may be connected to the exhaust port to draw air through holes 22. When air flow and the particles created by the disc in the housing 14 move in circular direction 95, the centrifugal force will cause the air and particles to leave the rotating surface tangently in the direction of arrow 97 through the opening 31. It has been found that the force of this air movement and the force of the particles being rotated by the high speed rotating disc 51 are such that the particles and air may be driven directly through exit tube 96 to bag 94. In other instances, for example where the particles being ground may be large or voluminous, it can be desirable to have a connecting vacuum pump arrangement as illustrated in FIG. 5. In either case, it is the object of this invention to provide a simple attachment that functions as a shield to protect the user from being hit by high speed dust or high speed particles, and yet have a grinder that is entirely flexible and easy to use, and which may be moved around and easily transported. Further the shield is so positioned on the grinder that it conforms to the work surface, is transparent so that the user may observe the work surface, and is easily fitted to standard grinding discs and abrasive wheels. While the shield works best with the vacuum pump attached, it also works very well with a simple dust collection bag attached to the end of the hose on the exhaust port.

Having described our invention, we now claim:

1. A shield for rotary grinders that rotate a grinding disc for grinding or sanding a work surface comprising;

a hood having an upper surface and a continuous, circular skirt for enclosing a rotatable grinding disc that, when rotating, causes movement of particles and airflow in said hood, an exhaust opening through said skirt for passage of particles and air to a tangently connected exhaust, an air opening in said hood feeding air to the airflow, said air opening being in said upper surface of said hood, said circular skirt having a lower circular edge for contacting the work surface, and said upper surface of said hood having a circular flexible section for resilient vertical movement of said circular skirt edge in maintaining contact between the skirt edge and the work surface.

2. A shield for rotary grinders as claimed in claim 1 in which, said upper surface having an attachment collar for fitting to a conventional grinder, which attachment collar has a central opening for passing a rotary drive for rotating the rotatable grinding disc, and said circular flexible portion is spaced radially outward from said attachment collar.

3. A shield for rotary grinders as claimed in claim 2 in which, said exhaust opening having a lower edge, and said edge being adjacent the lower edge surface of said skirt.

4. A shield for rotary grinders as claimed in claim 3 in which, said tangently connected exhaust being angled upwardly from the plane of the lower circular edge surface of said circular skirt.

5. A shield for rotary grinders as claimed in claim 4 in which, said circular skirt having a circular scored indentation extending continuously around the outer surface of said skirt in a spaced location from the lower edge of said skirt for use in separating a section of said skirt to adjust the length of said skirt relative to the enclosed position of the rotatable disc.

6. A shield for rotary grinders as claimed in claim 5 in which, said hood being transparent for allowing viewing of the position of said rotary disc on the work.

7. A shield for rotary grinders as claimed in claim 6 in which, the resilient portion of said skirt having means for allowing resilient movement of any side portion of said skirt outwardly, inwardly or upwardly relative to the adjacent portion of the rotatable grinding disc.

8. A shield for rotary grinders that rotates a grinding disc for grinding or sanding a work surface comprising:

a hood having an upper surface and a continuous, circular skirt for enclosing a rotatable, grinding disc that, when rotating, causes movement or particles and air flow in said hood, a tubular exhaust extending through said skirt and tangently from the outer periphery of said skirt and in the direction of the air flow, an air opening in said hood for feeding air to the air flow, said circular skirt having a lower circular edge for contacting the work surface, and said hood having a circular flexible section for permitting resilient vertical movement of said circular skirt edge for maintaining contact between the skirt edge and the work surface.

* * * * *